US009441425B2

(12) United States Patent
Villareal et al.

(10) Patent No.: US 9,441,425 B2
(45) Date of Patent: Sep. 13, 2016

(54) DRILLING TOOL SYSTEM AND METHOD OF MANUFACTURE

(71) Applicant: SCHLUMBERGER TECHNOLOGY CORPORATION, Sugar Land, TX (US)

(72) Inventors: Steven G. Villareal, Houston, TX (US); Julian Pop, Houston, TX (US); Kent David Harms, Richmond, TX (US); Jeremy Murphy, Sugar Land, TX (US); Albert Hoefel, Sugar Land, TX (US); Thomas W. Palmer, II, Stafford, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 716 days.

(21) Appl. No.: 13/653,091

(22) Filed: Oct. 16, 2012

(65) Prior Publication Data

US 2014/0102714 A1 Apr. 17, 2014

(51) Int. Cl.

| | |
|---|---|
| ***E21B 49/10*** | (2006.01) |
| ***E21B 17/02*** | (2006.01) |
| ***E21B 49/08*** | (2006.01) |
| *E21B 47/12* | (2012.01) |

(52) U.S. Cl.

CPC ..... *E21B 17/02* (2013.01); *E21B 49/08* (2013.01); *E21B 49/10* (2013.01); *E21B 17/028* (2013.01); *E21B 47/12* (2013.01)

(58) Field of Classification Search

CPC ..... E21B 47/00; E21B 47/06; E21B 47/12; E21B 49/00; E21B 49/003; E21B 49/08; E21B 49/10; E21B 49/086; E21B 49/081; E21B 7/04; E21B 17/028; E21B 17/03

See application file for complete search history.

(56) References Cited

U.S. PATENT DOCUMENTS

| | | | |
|---|---|---|---|
| 7,543,659 | B2 | 6/2009 | Partouche et al. |
| 7,594,541 | B2 | 9/2009 | Ciglenec et al. |
| 7,600,420 | B2 | 10/2009 | Meek |
| 7,886,832 | B2 | 2/2011 | Partouche |
| 7,913,774 | B2 | 3/2011 | Partouche |
| 7,938,199 | B2 | 5/2011 | Welshans et al. |
| 8,113,280 | B2 | 2/2012 | Sherrill |
| 2005/0284629 | A1 | 12/2005 | Reid et al. |

(Continued)

FOREIGN PATENT DOCUMENTS

| | | | |
|---|---|---|---|
| GB | 2252422 | A | 8/1992 |
| WO | 2007146801 | A2 | 12/2007 |

OTHER PUBLICATIONS

International Search Report and the Written Opinion for International Application No. PCT/US2013/06449 dated Jan. 27, 2014.

(Continued)

*Primary Examiner* — Robert E Fuller
*Assistant Examiner* — David Carroll
(74) *Attorney, Agent, or Firm* — Kenneth L. Kincaid

(57) ABSTRACT

A drilling system includes a first section of a drilling tool having a collar configured to hold internal components of the first section. The drilling system also includes a second section of the drilling tool configured to be coupled with the first section in a specific orientation relative to the first section. The second section is interchangeable with at least one different section.

19 Claims, 5 Drawing Sheets

(56) References Cited

U.S. PATENT DOCUMENTS

| | | | | |
|---|---|---|---|---|
| 2006/0157253 | A1* | 7/2006 | Robichaux et al. | 166/359 |
| 2006/0279078 | A1 | 12/2006 | Johnson et al. | |
| 2008/0115575 | A1 | 5/2008 | Meek et al. | |
| 2009/0195250 | A1* | 8/2009 | Welshans et al. | 324/324 |
| 2010/0243265 | A1 | 9/2010 | Sherrill et al. | |
| 2011/0094757 | A1* | 4/2011 | Milkovisch et al. | 166/387 |

OTHER PUBLICATIONS

European Search Report issued in related EP application 13846399.7 on Jul. 6, 2016, 4 pages.

* cited by examiner

DRILLING TOOL SYSTEM AND METHOD OF MANUFACTURE

BACKGROUND

The present disclosure relates generally to drilling systems and more particularly to downhole drilling tools and the manufacture thereof.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in an annulus between the drill string and the borehole wall.

For successful oil and gas exploration, it is necessary to have information about the subsurface formations that are penetrated by a borehole. For example, one aspect of standard formation evaluation relates to measurements of the formation pressure, formation permeability and the recovery of formation fluid samples. These measurements are essential to predicting the economic value, the production capacity, and production lifetime of a subsurface formation.

One technique for measuring formation properties includes lowering a "wireline" tool into the well to measure formation properties. A wireline tool is a measurement tool that is suspended from a multi-wire cable as it is lowered into a well so that is can measure formation properties at desired depths. A typical wireline tool may include a probe that may be pressed against the borehole wall to establish fluid communication with the formation. This type of wireline tool is often called a "formation tester." Using the probe, a formation tester measures the pressure of the formation fluids and generates a pressure pulse, which is used to determine the formation permeability. The formation tester tool also typically withdraws a sample of the formation fluid for analysis within the tool and/or for later analysis.

In order to use any wireline tool, whether the tool is a resistivity, porosity, or formation testing tool, the drill string must be removed from the well so that the tool can be lowered into the well. This is called a "trip" downhole. Further, wireline tools must be lowered to the zone of interest, generally at or near the bottom of the hole. A combination of removing the drill string and lowering the wireline tools downhole are time-consuming measures and can take many hours and even days, depending upon the depth of the borehole. Because of the expense and rig time required to "trip" the drill pipe and lower the wireline tools down the borehole, wireline tools are generally used only when the information is greatly desired. A drill string may be tripped for other reasons, such as changing the drill bit.

As an improvement to wireline technology, techniques for measuring formation properties using tools and devices that are positioned near the drill bit in a drilling system have been developed. Thus, formation measurements are made during the drilling process, and the terminology generally used in the art is "MWD" (measurement-while-drilling) and "LWD" (logging-while-drilling). MWD typically refers to measuring the drill bit trajectory, as well as borehole temperature and pressure, while LWD typically refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process.

Recently, the equivalent of wireline formation testing tools have been introduced on the drill string: tools capable of measuring the pressure and permeability of formations and capable of extracting large volumes of formation fluids and capturing representative samples. Unlike wireline formation testers, these drilling formation testers are confined, due to the harsh (pressure, temperature, shock and vibration, etc.) environment under which drilling takes place, to operate within collars. Such collars constitute a part of a drilling bottom-hole assembly. Collars, amongst other functions, serve to house and protect the drilling formation tester while allowing the passage of mud past the drilling formation tester on its way to the drill bit at the bottom of the drilling assembly. The commonly-used approach of housing the drilling formation tester within a single collar can place restrictions on the utility of these tools: For example, with a fixed collar configuration (e.g., having a fixed diameter and length), the range of borehole sizes within which the tool may be successfully operated is generally narrow. In addition, the choice of probe types which may be used to address wide ranging pressure testing and sampling conditions is limited unless multiple variants of these relatively expensive collars are kept in inventory. Further, not all applications of these tools utilize identical tool configurations.

A sampling formation tester having a fixed, inflexible configuration can result in less than optimal performance. Further, at significant depths, substantial hydrostatic pressure and high temperatures are experienced, thereby further complicating matters. Still further, formation testing tools are operated under a wide variety of conditions and parameters that are related to both the formation and the drilling conditions. Therefore, there is a need for improved downhole formation evaluation tools and improved techniques for operating and controlling such tools so that such downhole formation evaluation tools are more reliable, efficient, and adaptable to both formation and mud circulation conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In a first embodiment, a drilling system includes a first section of a drilling tool having a collar configured to hold internal components of the first section, and a second section of the drilling tool configured to be coupled with the first section in a specific orientation relative to the first section. The second section is interchangeable with at least one different section.

In another embodiment, a drilling system includes a transition block configured to couple a first section and a second section of a drilling tool. The second section is interchangeable with one or more different sections of the drilling tool. The transition block is configured to couple with the second section in a specific relative orientation. The transition block is configured to be disposed in a collar of the first section without regard to an orientation of the transition block relative to the collar such that the collar can be rotatably coupled with the second section.

In a further embodiment, a method of manufacturing a drilling tool includes attaching a transition block of a first section of the drilling tool to a second section of the drilling tool. The method also includes disposing the transition block within a collar of the first section. In addition, the method includes attaching the collar to the second section without regard to an orientation of the collar relative to the second section.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
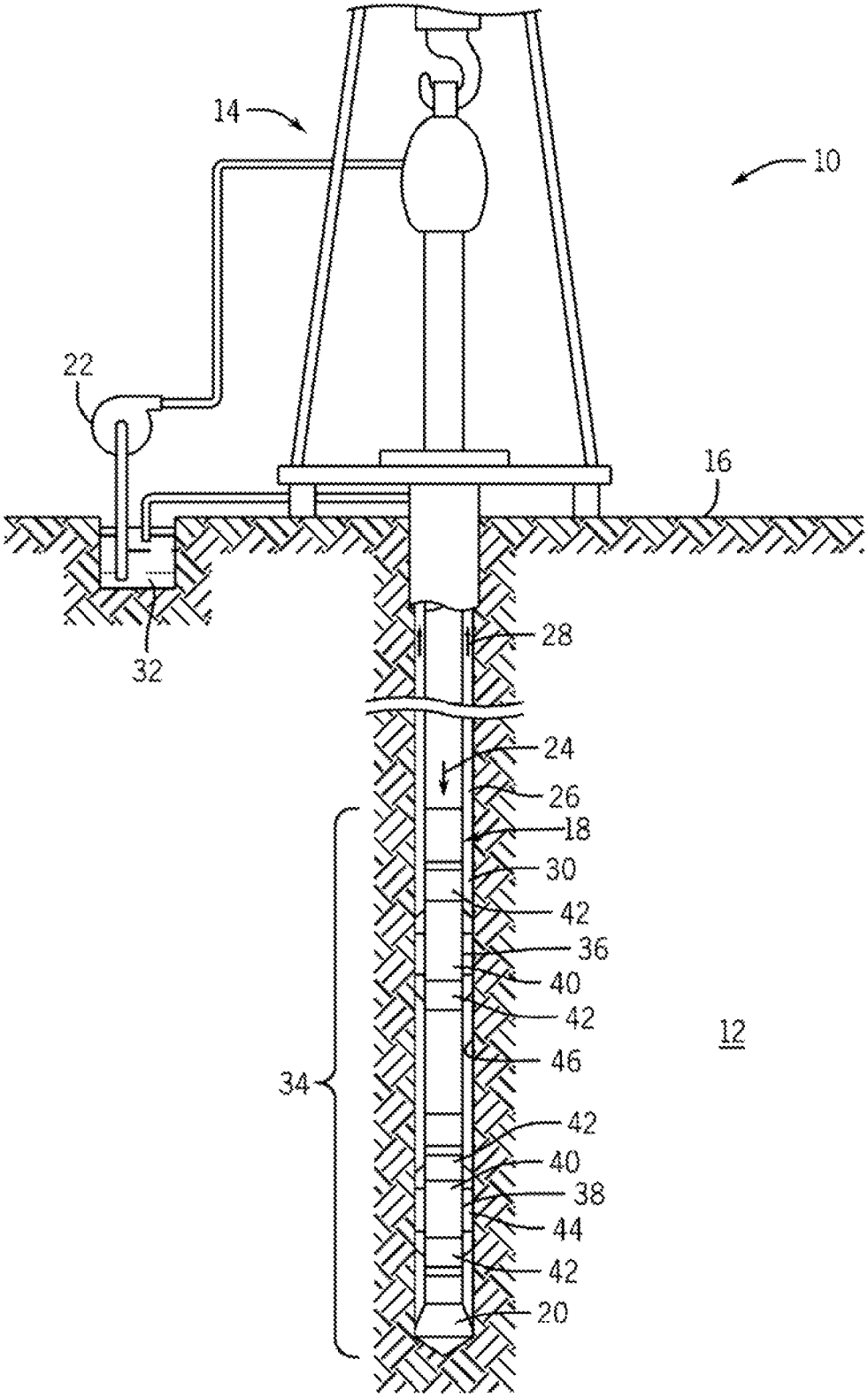
FIG. 1 is a partial cross sectional view of an embodiment of a drilling system used to drill a well through subsurface formations.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments are directed to systems and methods for connecting sections of a drilling tool or apparatus, such as a probe module of a logging-while-drilling ("LWD") tool. The drilling tool includes a first section and a second section, and the second section may be interchangeable with multiple different sections of the drilling tool. This allows the drilling tool to be configured with a section appropriate for a specific drilling job (e.g. based on the particular well formation). The first section includes components of the drilling tool that are common for each of the interchangeable sections. For example, the first section may be a utility section of a probe module, while the second section includes a probe section having a certain type of probe for sampling the well formation. The two sections may be connected using a transition block, which forms an interior part of the first section. The transition block may be coupled with the second section in a specific relative orientation (e.g., rigidly attached to an interior portion of the second section), and a collar of the first section may be positioned over the transition block and coupled to an outer portion of the second section. The collar may be coupled to the outer portion without regard to a relative orientation of the collar and the second section. By using the transition block to form this connection, it is possible to use a single utility section with various interchangeable tools. Another benefit of this connection is that it may reduce drilling mud washout through certain tool sections thereby saving an unplanned trip and avoiding the associated lost time.

FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a "mud" pump 22 is used to pump drilling fluid, commonly referred to as "mud" or "drilling mud," downward through the drill string 18 in the direction of the arrow 24 to the drill bit 20. The mud, which is used to cool and lubricate the drill bit 20, exits the drill string 18 through ports (not shown) in the drill bit 20. The mud then carries drill cuttings away from the bottom of the borehole 26 as it flows back to the surface 16, as shown by the arrows 28 through the annulus 30 between the drill string 18 and the formation 12. While a drill string 18 is illustrated in FIG. 1, it will be understood that the embodiments described herein are applicable to work strings and pipe strings as well. At the surface 16, the return mud is filtered and conveyed back to a mud pit 32 for reuse.

It should be noted that the environment of the wellbore may vary widely depending upon the location and situation of the formations of interest. For example, rather than a surface (land-based) operation, the wellbore may be formed under water of various depths, in which case the topside equipment may include an anchored or floating platform, and some of the components used may be positioned at or near a point where the well enters the earth at the bottom of a body of water.

As illustrated in FIG. 1, the lower end of the drill string 18 includes a bottom-hole assembly ("BHA") 34 that includes the drill bit 20, as well as a plurality of drill collars 36, 38 that may include various modules and instruments, such as sensors, telemetry equipment, pumps, sample chambers, and so forth. For example, the drill collars 36, 38 may include logging-while-drilling ("LWD") modules 40 and/or measurement-while drilling ("MWD") modules 42. The LWD modules 40 of FIG. 1 are each housed in a special type of drill collar 36, 38, and each contain any number of logging tools and/or fluid sampling devices. The LWD modules 40 include capabilities for measuring, processing and/or storing information, as well as for communicating with the MWD modules 42 and/or directly with the surface equipment such as, for example, a logging and control computer.

In certain embodiments, the modules may include probes disposed within a centralizer or stabilizer 44. In certain embodiments, the centralizer/stabilizer 44 comprises blades that are in contact with the borehole wall 46 as shown in FIG. 1 to limit "wobble" of the drill bit 20. "Wobble" is the tendency of the drill string 18, as it rotates, to deviate from the vertical axis of the borehole 26 and cause the drill bit 20 to change direction. Advantageously, the centralizer/stabilizer 44 is already in contact with the borehole wall 46, thus requiring less extension of a probe from the module to establish fluid communication with the formation 12. It will be understood that a formation probe may be disposed in locations other than in the centralizer/stabilizer 44 without departing from the scope of the presently disclosed embodiments.

Present embodiments are directed toward drilling tools that may include multiple sections. Specifically, a drilling tool may include a first section and a second section configured to be coupled together in a specific orientation relative to one another. The first section may be common to the general type of tool, and multiple interchangeable sections that may be selected for a specific drilling job. A unique connection, described in detail below, may be utilized to couple different interchangeable sections with the same first section. Specifically, a transition block may facilitate multiple electrical and/or fluid connections between the two sections. While the presently described techniques may be applied to many different types of downhole equipment and across a range of drilling applications (e.g., sampling while drilling, formation pressure while drilling, wireline formation testing, etc.), the illustrated embodiments show the use of the transition block for connecting sections of an LWD tool 40.

Figure 2:
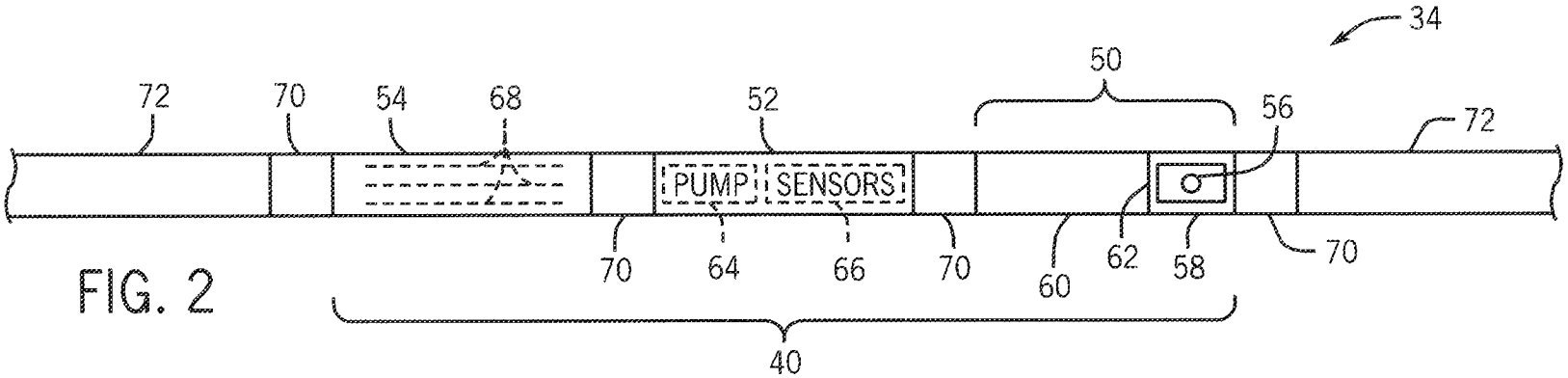
FIG. 2 is a schematic diagram of an embodiment of downhole drilling equipment used to sample a well formation.

FIG. 2 is a schematic diagram of an embodiment of downhole drilling equipment that may form part of the BHA 34 of FIG. 1. Specifically, the illustrated downhole drilling equipment includes an LWD tool 40 that may be used to collect fluid samples from the formation 12 during the drilling process. According to certain embodiments, the LWD tool 40 may be designed to provide sampling while drilling functionality. The LWD tool 40 includes a probe module 50, a pump-out module 52, and a sample carrier module 54, which work together to collect formation fluid samples. The probe module 50 includes an extendable fluid communication line (probe 56) designed to engage the formation 12 and to communicate fluid samples from the formation 12 into the LWD tool 40. In addition to the probe 56, the probe module 50 includes certain electronics, batteries, and/or hydraulic components used to operate the probe 56. It should be noted that FIGS. 2-4, and 6 include drilling tool components that are oriented such that the end shown at the top (or right) of the page corresponds with a downhole end of the drilling tool, while the end shown at the bottom (or left) of the page corresponds with an uphole end. In FIG. 2, for example, the sample carrier module 54 is located relatively uphole of the probe module 50.

In the illustrated embodiment, the probe module 50 includes two sections coupled together as described above, one section (probe section 58) having the probe 56 and the other section (utility section 60) having certain components used to operate the probe 56. The utility section 60 may be coupled with any number of different probe sections 58, making the probe section 58 interchangeable. Each of the probe sections 58 may include a different type of probe 56 designed specifically to draw in sample fluid from a different type of formation 12. The utility section 60 may include components that are common for operating each different probe 56 and for performing measurements at one or more probes 56. In one embodiment a connection 62 between the utility section 60 and the probe section 58, as described in detail below, may be made in a shop before the constructed probe module 50 is transported to the drilling rig 14 for use. That is, the connection 62 between the utility section 60 and the probe section 58 may be different from other connections that are generally made between different modules of the LWD tool 40, or between the LWD tool 40 and other drilling equipment, in the field after the sections 58, 60 have been transported to the work site. It should be noted that FIGS. 2-4, and 6 include drilling tool components that, when connected and operating in the wellbore, are oriented such that the probe section 58 is located in a relatively downhole location compared to the utility section 60.

In certain embodiments, the pump out module 52 includes a pump 64 for pumping formation sample fluid from the probe module 50 to the sample carrier module 54 and/or out of the LWD tool 40. In an embodiment, the pump 64 may include an electromechanical pump, which operates via a piston displacement unit (DU) driven by a ball screw, such as a planetary rollerscrew, coupled to a gearbox and electric motor. Mud check valves may be employed to direct pumping fluid in and out of chambers of the DU, thereby allowing continuous pumping of formation fluid even as the DU switches direction. Power may be supplied to the pump 64 via a dedicated mud turbine/alternator system. In addition to the pump 64, the pump-out module 52 may include a number of sensors 66 used to monitor one or more parameters of the sample fluid moving through the pump-out module 52. For example, the sensors 66 may include two pressure gauges, one to monitor an inlet pressure (e.g., pressure at the probe 56 of the probe module 50), and another to monitor an outlet pressure (e.g., pressure of fluid entering the sample carrier module 54). In addition, the sensors 66 may measure other fluid properties or characteristics such as density, viscosity, temperature, fluid composition, and so forth. Although the pump-out module 52 is included in the illustrated embodiment of the LWD tool 40, it should be noted that the LWD tool 40 may operate without a separate pump-out module 52. For example, certain components internal to the illustrated pump-out module 52 may be located in the utility section 60 of the probe module 50. As another example, the LWD tool 40 may sample the formation via the probe module 50 without using a pump to direct the samples through the LWD tool 40.

Once the formation fluid is taken into the probe module 50, the pump 64 urges the formation fluid through the LWD tool 40 and toward the sample carrier module 54. The sample carrier module 54, in general, includes multiple sample bottles 68, for example, three or more, which may be 450-cc sample bottles configured to receive and store the sample fluid (samples of the formation fluid obtained via the probe section 58). The sample carrier module 54 may then be brought to the surface for analysis of the fluid samples. Valves are employed to open the sample bottles 68, usually one at a time, to receive the sample fluid pumped through the LWD tool 40 and to close the sample bottles 68 when they are filled to a desired level. In certain embodiments, the LWD tool 40 may operate without the illustrated sample carrier module 54. For example, the LWD tool 40 may utilize the probe module 50 to obtain formation pressure measurements. In these embodiments, the LWD tool 40 may include sensors (e.g., 66) for determining properties of the formation fluid, which may be drawn into the probe module 50 and then released to the wellbore.

As previously discussed, the LWD tool 40 represents only a portion of the BHA 34 and the drill string 18. As the drill string 18 is made up at the surface 16, the modules of the LWD tool 40 are connected via field joints 70. The field joints 70 represent rugged connections between drilling equipment that may be made at the well site. The field joints 70 may facilitate one or more rotatable electrical and/or hydraulic connections. That is, the field joints 70 may be specially designed to provide electrical communication, sampling fluid communication, and/or hydraulic fluid communication between the probe module 50, the pump-out module 52, the sample carrier module 54, and other drilling equipment 72. This other drilling equipment 72 may include the MWD modules 42, other LWD tools, drill collars, or other drill string components. In some embodiments, the other drilling equipment 72 may include additional modules of the same LWD tool 40, such as another pump-out module 52 on the other side of the probe module 52, or additional sample carrier modules 54. Since the field joints 70 provide rotatable connections between these modules, the modules may be positioned in any orientation relative to each other without fluid and/or electricity flowing to an undesired location. The connection 62 between the probe section 58 and the utility section 60 of the probe module 50, however, couples the probe section 58 (and an outer surface of the probe section 58) in a specific rotational orientation to certain components within the utility section 60.

Figure 3:
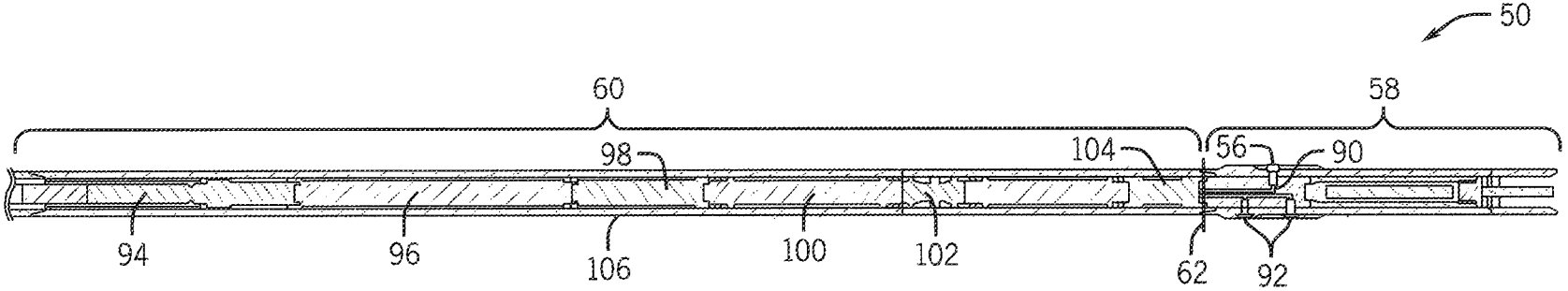
FIG. 3 is a longitudinal cross sectional view of an embodiment of a drilling tool used to sample a well formation.

FIG. 3 is a longitudinal cross sectional view of an embodiment of the probe module 50 of FIG. 2, which illustrates functional components internal to the probe section 58 and the utility section 60 of the probe module 50. The probe section 58 includes a block 90 from which the probe 56 extends. It should be noted that the block 90 may be a solid piece that extends out to the edge of the probe section 58, effectively forming an outer collar of the probe section 58. Since the probe 56 extends from one solid piece, as opposed to a block detached from but housed within a separate collar, there is a reduced chance of high pressure mud from inside the tool leaking across seals resulting in erosion of the inner components of the probe section 58 as drilling mud passes therethrough. It should be noted, however, that the connection 62 between the utility section 60 and the probe section 58 is not limited to use with probe sections 58 having a block 90 that is a solid piece. For example, other embodiments of the probe section 50 may include two or more pieces connected together to form the illustrated block 90 from which the probe 56 extends. On an opposite edge of the block 90 from the probe 56, the illustrated probe section 58 includes two setting apparatus 92. In the illustrated embodiment, the setting apparatus 92 are pistons, but other probe sections 58 may utilize different types of setting apparatus 92, as described below. When the probe module 50 extends the probe 56 to take a sample of the formation 12, the setting apparatus 92 are simultaneously extended from the probe section 58 in the opposite direction to press against an opposite wall of the borehole 46. This allows the probe 56 in the probe module 50 to establish an effective seal against the borehole wall 46 to perform a formation pressure test and/or formation sampling.

In general, the utility section 60 includes components of the probe module 50 that operate the same way for different probe sections 58. For example, the utility section 60 of the probe module 50 may include a battery 94, electronics 96, hydraulics 98, a pretest/sensor device 100, a pressure equalizer valve 102, and a transition block 104. A collar 106 is configured to hold these functional components of the utility section 60. During operation, the battery 94 supplies electrical power to the electronics 96, and the electronics 96 control operation of the hydraulics 98 (e.g., to actuate the probe 56) to facilitate collection of fluid samples and other aspects of the tool operation. The pretest/sensor device 100 may send signals to the electronics based on tests performed on a relatively small volume of fluid collected via the probe 56. The pretest/sensor device 100 may signal the electronics 96, for example, that a pressure of the formation, a pressure of the wellbore, a formation parameter (e.g., permeability), or a parameter of an initial fluid sample, is appropriate for the initiation of sampling. The electronics 96, in response, may operate the hydraulics to further extend the probe 56 and/or the setting apparatus 92 in order to maintain a seal of the probe 56 against the wellbore wall 46 during the intake of fluid through the probe 56. The utility section 60 may operate in other ways than described herein, and in certain embodiments, certain components in the illustrated utility section 60 may be included in other modules of the LWD tool 40 (e.g., pump-out module 52).

In order to facilitate communication of electricity and fluids between the utility section 60 and the probe section 58, the connection 62 between these sections permits at least two fluid connections and multiple electrical connections. Specifically, the connection 62 facilitates fluid communication of at least the hydraulic fluid for actuating the probe 56 or other devices, and the formation fluid received through the probe 56. In addition, the connection 62 permits the flow of electrical power and communications (e.g., data buses such as controller area network (CAN), modem line, etc.) between the utility section 60 and the probe section 58. The connection 62 may include multiple electrical pin connections for establishing electrical communication between the utility section 60 and the probe section 58. In certain embodiments, the connection 62 may allow electricity to pass through the probe module 50 itself, thereby facilitating electrical connections between drilling equipment on either side of the probe module 50.

The transition block 104 is configured to couple the utility section 60 and the probe section 58, ultimately facilitating this unique connection 62. As previously mentioned, the transition block 104 is not limited to use with the probe module 50. The probe module 50 is one example of an application for using the transition block 104 to connect interchangeable drilling components. With this in mind, the illustrated embodiment shows the transition block 104, which is designed to couple with the probe module 58 in a specific relative orientation. In this way, there is greater flexibility in placement of the electrical and fluid connections, since they do not have to be routed axisymmetrically or concentrically (e.g., through the center of the transition block 104). The transition block 104, along with the other components internal to the utility section 60, is disposed in the collar 106 of the utility section 60 without regard to the relative orientation of the transition block 104 and the collar 106. As a result, the collar 106 may be rotatably coupled (e.g., threaded) with the probe section 58.

Figure 4:
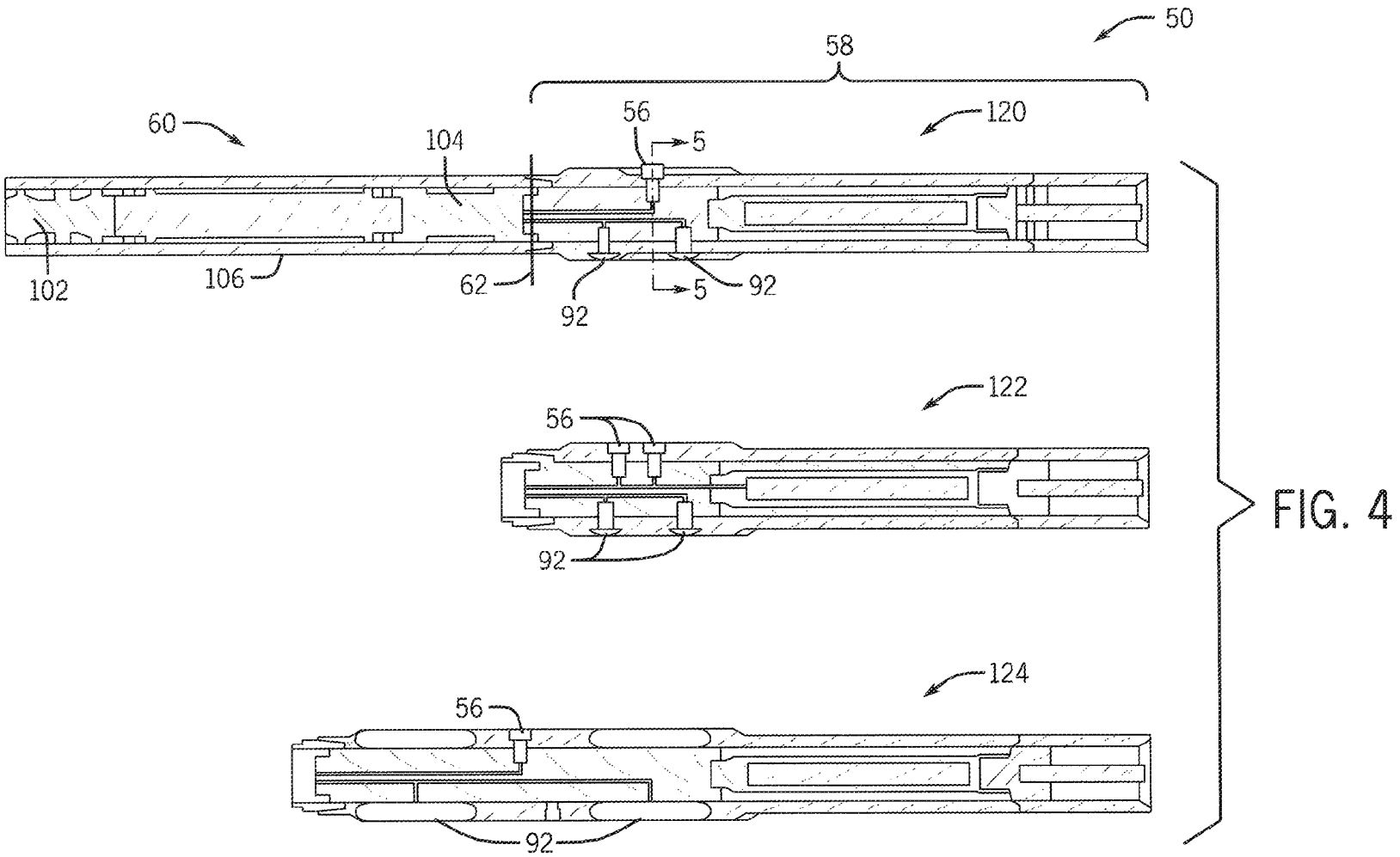
FIG. 4 is a longitudinal cross sectional view of an embodiment of the drilling tool of FIG. 3 having an interchangeable probe section.

As previously noted, the utility section 60 may include some or all of the components used to operate different types of probes 56. This allows the same utility section 60 to be coupled with any number of interchangeable probe sections 58, as shown in FIG. 4. For example, the utility section 60 may be coupled with a single probe section 120, a dual probe section 122, a focused sampling probe section (not shown), a straddle packer section 124 (having inflatable packers as the setting apparatus 92), or a single packer section (not shown). The probe sections 58 may be configured based on the testing and/or sampling job of the probe module 50. Each different type of probe 56 of the different probe sections 58 (e.g., 120, 122, 124) may be configured to take pressure measurements and/or samples from a different type of formation. For example, the straddle packer 124 may be employed to take formation fluid samples from relatively low mobility or fractured formation. The probe 56 of the straddle packer section 124 may include a formation fluid inlet for receiving the formation fluid, instead of a hydraulically actuated probe as in other probe sections 58. Further, the probes 56 of different probe sections 58 may vary based on shape (e.g., circular, elliptical, multiple probe, or focused probe). In some embodiments, different probe sections 58 may have the same type of probe 56 but a different type of setting apparatus 92 (e.g., piston, packer, etc.), existence of stabilizers, different size of the setting apparatus 92, and/or different distance that the setting apparatus 92 and the probe 56 extend from the probe section 58. For example, it may be desirable to use a probe section 58 configured for use in 8.5 inch boreholes, as opposed to a different sized borehole, depending on the well being drilled. Certain of the interchangeable probe sections 58 may include additional features, such as a device to divert drilling mud from the utility section 60 toward the annulus 30 before the mud reaches certain inner components of the probe section 58 (e.g., in packer modules).

In addition to interchanging the different probe sections 58 used with the same utility section 60, it may be desirable to have multiple connections 62 to connect a plurality of different probe sections 58 in the same LWD tool 40. That is, the same utility section 60 may be coupled with a first probe section 58, and the first probe section 58 may be coupled via another transition block 104 to a second probe section 58. This may allow the same probe module 50 to take samples using one of two different probe sections 58 connected in series with the same utility section 60, based on the type of formation 12 encountered at a certain depth. This may reduce the amount of time spent pulling the entire drill string out of the well and adding a different probe section 58 or probe module 50 when problems are encountered with the sampling. In addition, this would allow any number of different probe sections 58 to be powered using the same power supply (in the utility section 60). It should be noted that while it is possible to connect multiple probe sections 58 in series and to operate them using the same utility section 60, the number of probe sections 58 may be limited by a total length of the fully constructed probe module 50.

Figure 5:
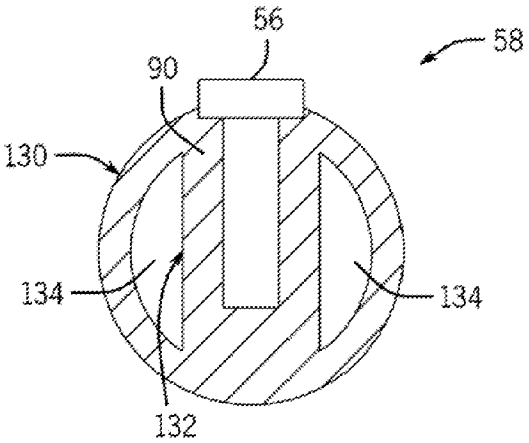
FIG. 5 is a radial cross sectional view of an embodiment of a section of the drilling tool of FIG. 3.

FIG. 5 is a radial cross sectional view, taken within line B-B of FIG. 4, of the probe section 58. This view shows the solid block 90 that forms both a collar 130 and an inner portion 132 of the probe section 58, from which the probe 56 extends. In addition, there are two drilling fluid channels 134 through the illustrated probe section 58 for conveying drilling mud through the probe section 58 and toward the drill bit 20. In some embodiments, rather than two separate drilling fluid channels, there may be one relatively larger drilling fluid channel 134 for conveying the drilling fluid therethrough. In other embodiments, there may be more than two drilling fluid channels 134. The drilling fluid channels 134 may be arranged symmetrically, as shown, pushed to one side or another, or have different relative shapes and sizes. Since the block 90 connects the inner portion 132 with the collar 130 of the probe section 58, there is a reduced chance of drilling mud leaking out of the probe section 58. In probe sections 58 where the inner portion 132 is disposed within a separate collar 130, there may be potential for washout through the extended probe 56. That is, the drilling mud could leak into a space between the collar 130 and the inner portion 132. Since the pressure in the drilling fluid channels 134 is much higher than the pressure of the circulating mud in the surrounding borehole 26, the leakage of mud could erode and ultimately lead to decreased performance of the probe section 58. In response to a leak, for example, drilling operation could be halted, the drill string 18 removed from the well, and the issue addressed above the surface. This increases the amount of time spent drilling, thereby reducing the overall drilling performance. In present embodiments, the probe section 58 is decoupled from the utility section 60 of the probe module 50, and it is possible for the collar 130 and the inner portion 132 to be part of the same block 90. This may reduce the likelihood of probe impairment due to drilling fluid washout. Again, such decoupling of sections of drilling equipment is not limited to probe modules 50, but may be utilized in other drilling tools where potential for drilling fluid washout otherwise exists.

Figure 6:
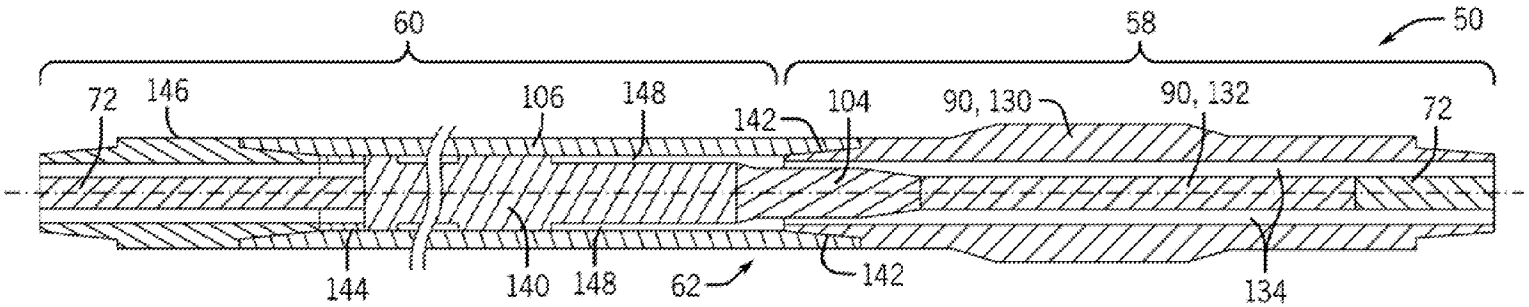
FIG. 6 is a longitudinal cross sectional view of an embodiment of a drilling tool having a transition block between a first section and a second section.

FIG. 6 is a longitudinal cross sectional view of an embodiment of the probe module 58, showing the transition block 104 in greater detail. In the illustrated embodiment, the transition block 104 is coupled to other interior components 140 (e.g., battery 94, electronics 96, hydraulics 98, pretest/sensor device 100, equalizer 102, pressure gauges, etc.) of the utility section 60. The transition block 104 is configured to couple with the body 90 of the probe section 58, and more specifically the inner portion 132 of the body 90. The transition block 104 may bolt or key into the probe section 58 in a specific relative orientation, allowing non-concentric electrical and/or fluid connections. Once this connection is made, the transition block 104 and other interior components 140 may be disposed in the collar 106, and the collar 106 may be coupled with the probe section 58 via threads 142. As illustrated, the transition block 104 may extend beyond the threads 142 of both collars 106 and 130. Accordingly, the threads 142 may be re-cut if they are damaged during the drilling process, which often imparts large forces on downhole drilling equipment (e.g., collar 106, 130). In the illustrated embodiment, the probe module 50 is fully assembled after insertion of a spring pack 144, which is held in place by a saver sub 146 threaded onto the collar 106. Again, the completed probe module 50 may be coupled with other drilling equipment 72 at one or both ends.

The transition block 104 and body 90 form the connection 62 described above with respect to FIGS. 2-4. This type of connection 62 may be established between other drilling components, such as sections of the MWD tool 42, the drill bit 20, or any other drilling equipment that may include one or more interchangeable sections. It should be noted that the connection 62 (e.g., transition block 104) may allow passage of the drilling fluid between the two sections that are connected. In FIG. 6, this is shown by drilling fluid flow channels 148 through the utility section 60 intersecting the drilling fluid flow channels 134 of the probe section 58. The transition block 104 may change size between the utility section 60 and the probe section 58 in order to accommodate any changes in a size of the drilling fluid flow channels 148 and 134 and/or the collars 106 and 130.

Figure 7:
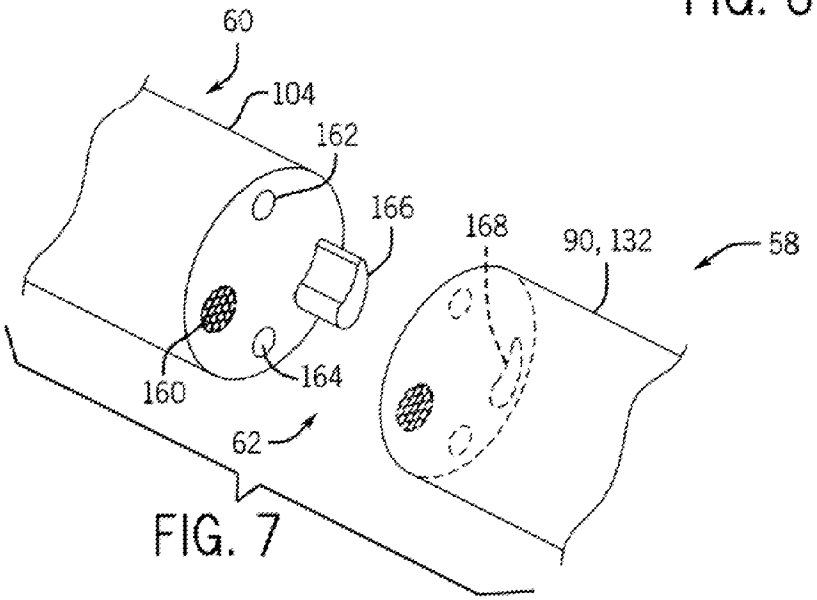
FIG. 7 is a perspective view of an embodiment of the transition block connecting with the second section of FIG. 6.

FIG. 7 is a perspective view of an embodiment of the connection 62, specifically between the transition block 104 and the inner portion 132 of the probe section 58. Again, this type of connection 62 may be established between any two sections of drilling equipment for which one of the sections is interchangeable with other sections of drilling equipment. The illustrated embodiment shows one possible arrangement of the electrical and fluid connections through the transition block 104. Specifically, the transition block 104 includes multiple electrical connections 160 for communicating power and telemetry between different drilling components, such as the utility section 60 and the probe section 58. According to certain embodiments, the electrical connections 160 may be pin and socket type connections. For example, the electrical connections 160 may include a multi-pin connection designed to mate with sockets of the probe section 58. Further, the electrical connections 160 may be grouped together and disposed on one side of the transition block 104.

In addition, the transition block 104 includes multiple fluid connections for maintaining separate fluid flows between the connected components (e.g., 58 and 60). For example, a sampling fluid connection 162 directs the formation fluid received through the probe 56 toward the sample carrier module 54. Similarly, a hydraulic fluid connection 164 allows a flow of hydraulic fluid from the hydraulics 98 of the utility section 60 to operate hydraulic actuators in the probe section 58. These electrical and fluid connections are not arranged concentrically, as they may be in other connecting joints of the drill string (e.g., field joints 70 having rotatable or concentric fluid and/or electrical connections). According to certain embodiments, the fluid connections 162 and 164 may be disposed on opposite sides of the transition block 104 from one another.

To maintain alignment of the electrical connections 160 and fluid connections 162 and 164 between the utility section 60 and the probe section 58, the utility section 60 and probe section 58 are coupled via the transition block 104 in a specific orientation relative to one another. The transition block 104 may include an indexing feature 166, for example a key, for maintaining the desired orientation between the utility section 60 and the probe section 58. In addition, the indexing feature 166 may receive and dissipate any elevated torsional loads at the connection 62, allowing the utility section 60 to transfer its rotation to the probe section 58. The illustrated indexing feature 166 is a key having an asymmetric shape extending from the transition block 104 to be received through a corresponding hole 168 in the probe section 58. According to certain embodiments, the indexing feature 166 may be disposed on an opposite side of the transition block 104 from the electrical connections 160. As shown in FIG. 7, the indexing feature 166 has a generally tear drop shaped cross-section. However, in other embodiments, the cross sectional shape of the indexing feature 166 may vary. For example, in certain embodiments, the indexing feature 166 may have a chevron or moon shaped cross-section.

As shown in FIG. 7, the fluid connections 162, 164, the electrical connections 160, and the indexing feature 166 are spaced around the outer circumference of the transition block 104. However, in other embodiments, the relative positions of the fluid connections 162, 164, the indexing feature 166, and the electrical connections 160 may vary. For example, in certain embodiments, the indexing feature 166 may extend from a center portion of the transition block 104. In another example, one of the fluid connections 162 may be disposed opposite from the indexing feature 166 or the electrical connections 160.

Figure 8:
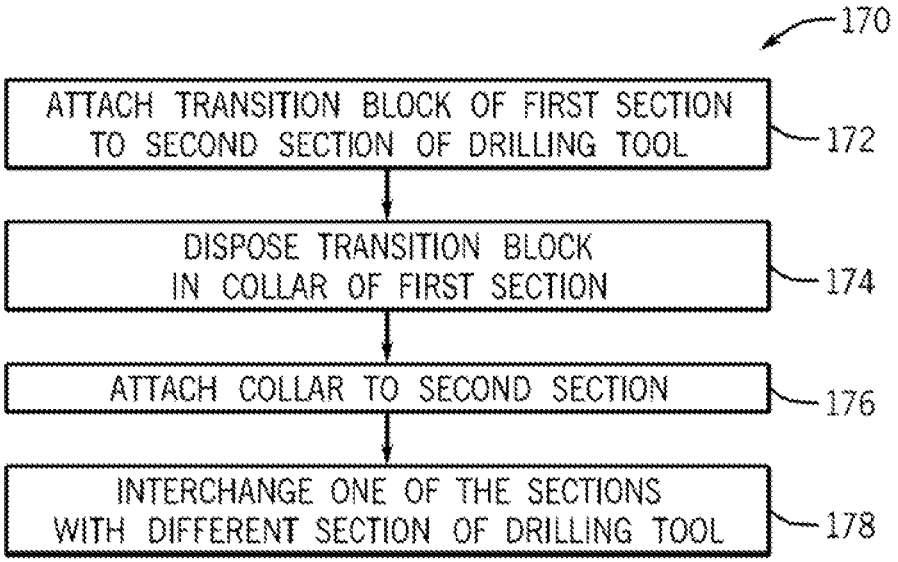
FIG. 8 is a process flow diagram of an embodiment of a method of manufacturing the drilling tool of FIG. 3.

FIG. 8 is a process flow diagram of an embodiment of a method 170 of manufacturing a drilling tool (e.g., probe module 50) using the transition block 104 described above. As noted above, while the method 170 may be utilized to manufacture the probe module 50 of the LWD tool 40 described in detail above, the method 170 is applicable to other drilling equipment having multiple interchangeable sections.

The method 170 includes attaching (block 172) a transition block (e.g., 104) of a first section (e.g., utility section 60) of a drilling tool (e.g., LWD tool 40) to a second section (e.g., probe section 58) of the drilling tool. The transition block may be part of whichever section of the drilling tool includes a collar separate from the internal components of that section. In the context of the probe module 50, as described above, the transition block 104 may be part of the utility section 60, since the collar 130 of the probe section 58 is a solid piece with the internal components of the probe section. The method 170 also includes disposing (block 174) the transition block in a collar (e.g., 106) of the first section of the drilling tool. The transition block may be coupled to a length of internal components (e.g., 140) of the first section that are also disposed in the collar. In addition, the method 170 includes attaching (block 176) the collar to the second section without regard to an orientation of the collar relative to the second section. The drilling tool may be configured such that its internal components are separated between the two sections such that any internal components that need to be clocked, or arranged in a specific orientation, relative to an outer collar of the tool are located in the second section. This allows the collar of the first section to be connected to the second section in any orientation relative to both the internal components of the first section (not clocked) and the second section. In the illustrated embodiment, the method 170 also includes interchanging (block 178) one of the sections with a different section of the drilling tool, such as a different probe section 58 of the probe module 50.

Figure 9:
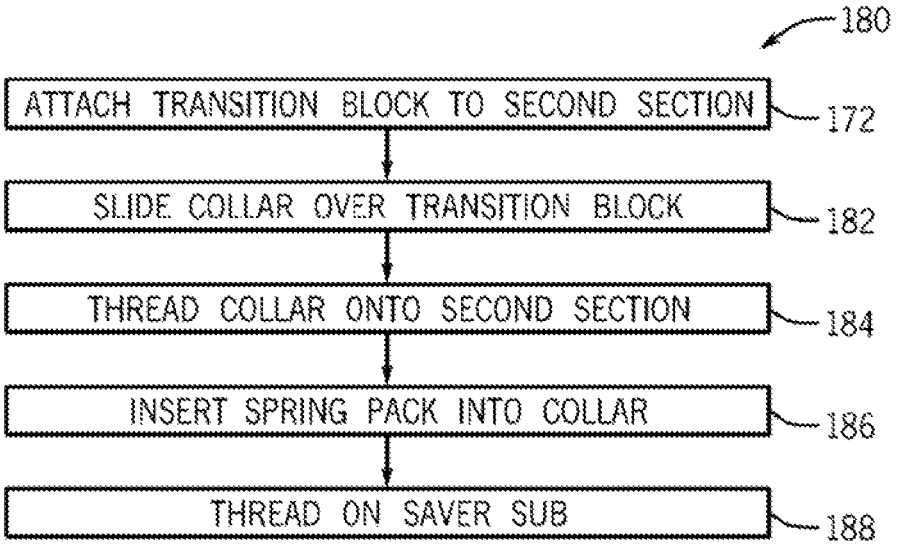
FIG. 9 is a process flow diagram of another embodiment of a method of manufacturing the drilling tool of FIG. 3.

FIG. 9 represents another method 180 of manufacturing the drilling tool that provides a more detailed description of the steps provided in the method 170. Specifically, blocks 182 and 184 of the method 180 correspond to the blocks 174 and 176 of method 170. The method 180 corresponds with a method of manufacturing the drilling tool (e.g., probe module 50) illustrated in FIG. 6. The method 180 includes attaching (block 172) the transition block (e.g., 104) of the first section (e.g., utility section 60) to the second section (e.g., probe section 58) of the drilling tool. Additionally, the method 180 includes sliding (block 182) the transition block into the collar of the first section, and threading (block 184) a first end of the collar onto the second section (e.g., via threads 142). The method also includes inserting (block 186) a spring pack (e.g., 144) into the collar, and threading (block 188) a saver sub (e.g., 146) onto a second end of the collar opposite the first end. The saver sub compresses the spring pack, which holds the internal components securely within the collar.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A drilling system, comprising:

a first section of a drilling tool having a transition block disposed in a collar configured to hold internal components of the first section; and a second section of the drilling tool having an inner portion and a collar portion of a solid block, wherein the collar is configured to rotatably couple with the collar portion, wherein the transition block is configured to be coupled with the inner portion in a specific, non-rotatable, orientation relative to the inner portion, and wherein the second section is interchangeable with at least one different section.

2. The drilling system of claim 1, wherein the drilling tool comprises a probe module, the first section comprises a utility section, and the second section comprises a probe section.

3. The drilling system of claim 2, wherein the utility section is configured to provide hydraulic power for extending a probe of the probe section.

4. The drilling system of claim 2, comprising a pump out module configured to direct formation fluid through the drilling tool to sample carrier module comprising sample bottles storing formation fluid.

5. The drilling system of claim 2, wherein the probe section is interchangeable with a plurality of different probe sections, each different probe section having a different type of probe or a different type of setting apparatus.

6. The drilling system of claim 1, wherein the transition block comprises:

two fluid connections to direct hydraulic fluid and sampling fluid between the first and second sections;

a multi-pin electrical connection to direct power flow between the first and second sections; and an asymmetric indexing feature configured to be received through a corresponding hole of the inner portion.

7. The drilling system of claim 1 wherein the collar portion is disposed around the inner portion.

8. A drilling system, comprising:

a transition block configured to couple a first section and a second section of a drilling tool, the second section being interchangeable with one or more different sections of the drilling tool;

wherein the transition block is configured to couple with an inner portion of the second section in a specific fixed relative orientation, and the transition block is configured to be disposed in a collar of the first section without regard to an orientation of the transition block relative to the collar such that the collar can be rotatably coupled with a collar portion of the second section.

9. The drilling system of claim 8, wherein the drilling tool comprises a probe module and the transition block is configured to couple a utility section of the probe module with a probe section of the probe module, the probe section having an extendable probe.

10. The drilling system of claim 9, wherein the transition block comprises at least two fluid connections and an electrical connection to direct hydraulic fluid, sampling fluid, and electricity between the utility section and the probe section.

11. The drilling system of claim 8, wherein the transition block comprises an indexing feature for receiving torsional loads between the transition block and the inner portion.

12. The drilling system of claim 11, wherein the indexing feature comprises an asymmetric key.

13. The drilling system of claim 8, wherein the transition block allows passage of drilling fluid between the first and second sections.

14. A method of manufacturing a drilling tool, comprising:

attaching a transition block of a first section of the drilling tool to an inner portion of a second section of the drilling tool in a specific, non-rotatable, orientation relative to the inner portion;

disposing the transition block within a collar of the first section; and attaching the collar to a collar portion of the second section without regard to an orientation of the collar relative to the collar portion.

15. The method of claim 14, comprising:

sliding the transition block into the collar;

threading a first end of the collar onto the collar portion;

inserting a spring pack into the collar; and threading a saver sub onto a second end of the collar.

16. The method of claim 14, comprising interchanging the second section with a different section of the drilling tool.

17. The drilling system of claim 1 wherein the second section comprises:

a probe extending from the solid block; and one or more drilling fluid channels extending within the second section between the inner portion and the collar portion.

18. The drilling system of claim 8, comprising the first and second sections of the drilling tool each coupled to the transition block, wherein the second section comprises a solid block forming the inner portion coupled to the transition block and the collar portion coupled to the collar of the first section.

19. The method of claim 14 wherein the second section comprises a solid block forming the inner portion and the collar portion, and wherein attaching the transition block to the inner portion comprises coupling an indexing feature of the transition block to a corresponding hole in the inner portion of the solid block.

* * * * *